US006427792B1

(12) United States Patent
Roberts et al.

(10) Patent No.: US 6,427,792 B1
(45) Date of Patent: Aug. 6, 2002

(54) ACTIVE GAUGE CUTTING STRUCTURE FOR EARTH BORING DRILL BITS

(75) Inventors: Tom Roberts, Abbeymead; Steven Barton, Aldbourne, both of (GB)

(73) Assignee: Camco International (UK) Limited (GB)

( * ) Notice: Subject to any disclaimer, the term of this patent is extended or adjusted under 35 U.S.C. 154(b) by 0 days.

(21) Appl. No.: 09/611,011

(22) Filed: Jul. 6, 2000

(51) Int. Cl.[7] ..... E21B 10/16; E21B 10/46

(52) U.S. Cl. ..... 175/431; 175/408; 76/108.2

(58) Field of Search ..... 175/393, 374, 175/408, 431; 76/108.2

(56) References Cited

U.S. PATENT DOCUMENTS

| | | | |
|---|---|---|---|
| 4,221,270 A | 9/1980 | Vezirian | |
| 4,231,438 A | 11/1980 | Garner et al. | |
| 4,440,247 A | 4/1984 | Sartor | |
| 5,010,789 A | 4/1991 | Brett et al. | |
| 5,103,922 A | 4/1992 | Jones | |
| 5,145,017 A | 9/1992 | Holster et al. | |
| 5,199,511 A | 4/1993 | Tibbitts et al. | |
| 5,265,682 A | 11/1993 | Russell et al. | |
| 5,303,785 A | 4/1994 | Duke | |
| 5,372,210 A | 12/1994 | Harrell | |
| 5,456,141 A | 10/1995 | Ho | |
| 5,553,679 A | 9/1996 | Thorp | |
| 5,582,259 A | 12/1996 | Barr | |
| 5,603,385 A | 2/1997 | Colebrook | |
| 5,608,162 A | 3/1997 | Ho | |
| 5,651,421 A | 7/1997 | Newton et al. | |
| 5,671,818 A | 9/1997 | Newton et al. | |
| 5,685,379 A | 11/1997 | Barr et al. | |
| 5,706,905 A | 1/1998 | Barr | |
| 5,778,992 A | 7/1998 | Fuller | |
| 5,803,185 A | 9/1998 | Barr et al. | |
| 5,819,860 A | 10/1998 | Newton et al. | |
| 5,904,213 A | 5/1999 | Caraway et al. | |
| 5,967,246 A | 10/1999 | Caraway et al. | |
| 5,992,547 A | 11/1999 | Caraway et al. | |
| 6,123,160 A * | 9/2000 | Tibbitts | 175/385 |

FOREIGN PATENT DOCUMENTS

| | | |
|---|---|---|
| WO | WO98/21440 | 5/1998 |
| WO | WO98/21441 | 5/1998 |

OTHER PUBLICATIONS

IADC/SPE 62779 "Development of Stable PDC Bits for Specific Use on Rotary Steerable Systems" by S. Barton. Paper was prepared of presentation at the 2000 IADC/SPE Asia Pacific Drilling Technology held in Kuala Lumpur, Malaysia Sep. 11–13, 2000.

IADC/SPE 23868 "An Analysis of the Field Performance of Antiwhirl PDC Bits" by J.M. Clegg. Paper was prepared for presentation at the 1992 IADC/SPE Drilling Conference held in New Orleans, Louisiana, Feb. 18–21, 1992.

* cited by examiner

*Primary Examiner*—David Bagnell
*Assistant Examiner*—Daniel P Stephenson
(74) *Attorney, Agent, or Firm*—Jeffery E. Daly

(57) ABSTRACT

The present invention is a drag-type drill bit for drilling a borehole in the earth. The bit is designed to rotate about a central axis of rotation and has a bit body having a leading face, an end face, a gauge region, and a shank for connection to a drill string, a plurality of nozzles in the bit body for delivering drilling fluid to the end face, a plurality of blades upstanding from the leading face of the bit body and extending outwardly away from the central axis of rotation of the bit. Each blade terminates in a gauge pad with a surface which faces a wall of the borehole. A first plurality of cutters are mounted on the blades at the end face of the bit body and a second plurality of cutters are mounted the gauge pads and arranged such that in operation, they cut the wall of the borehole. Each one of the second plurality of cutters has a backrake less than or equal to about 20 degrees. A plurality of non-cutting bearing element are mounted on the gauge pads in a trailing relationship relative to the rotation of the bit behind at least some of the second plurality of cutters. The surface of each gauge pad is relieved from the borehole by at least 3 mm.

22 Claims, 3 Drawing Sheets

Fig. 3
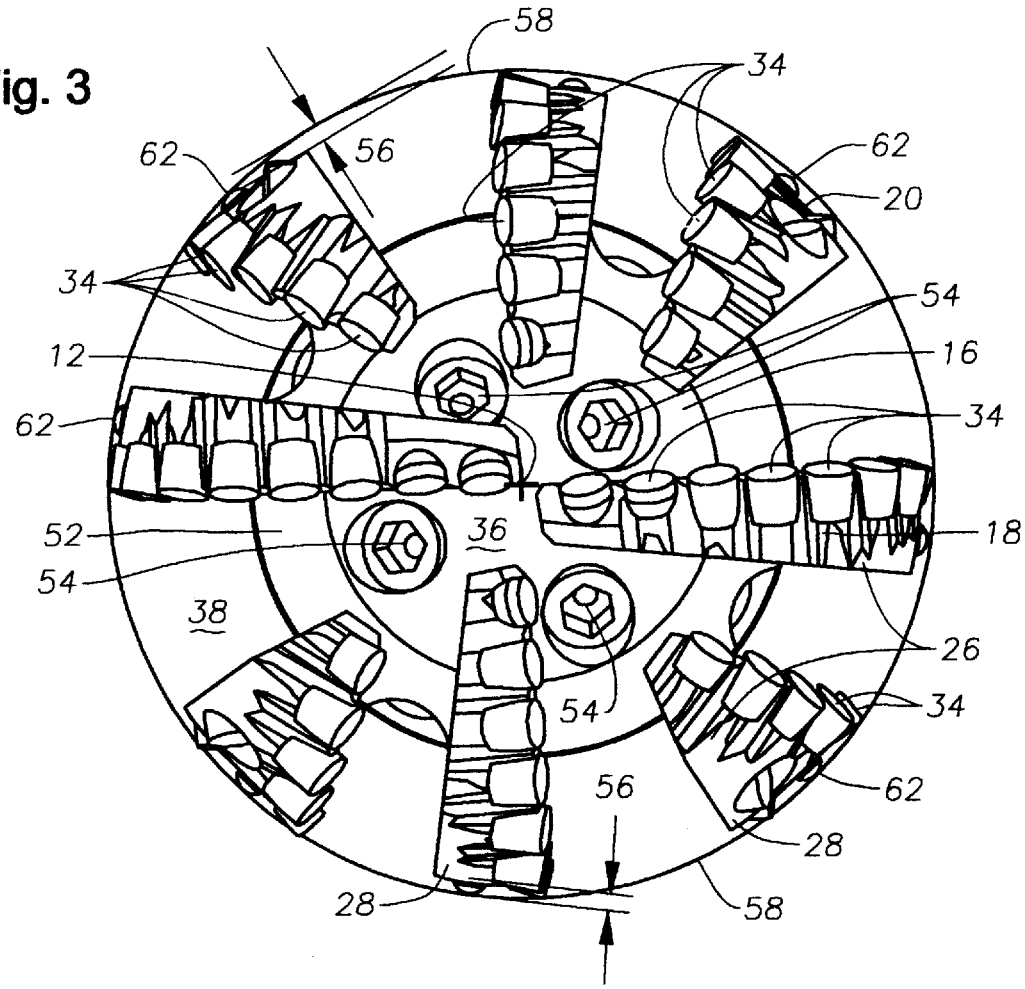
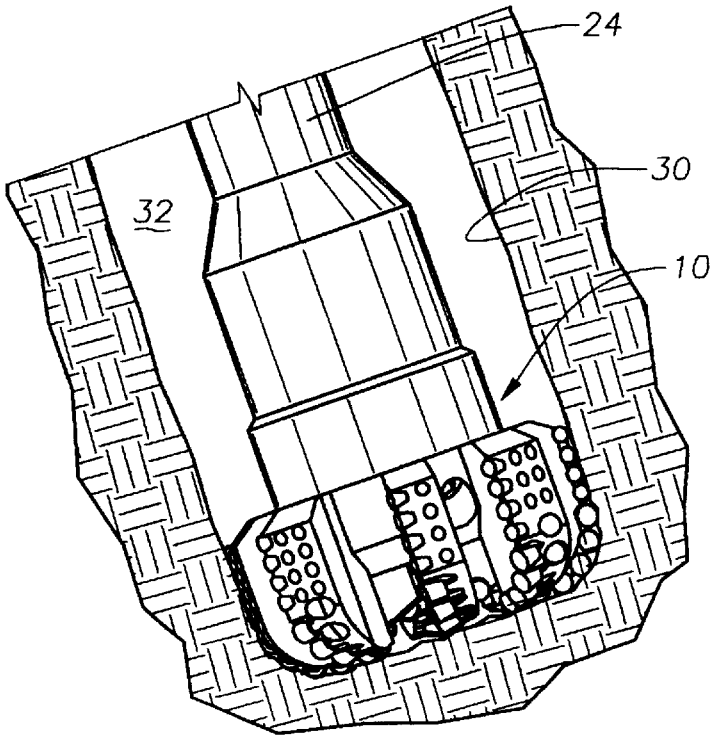
Fig. 4

ACTIVE GAUGE CUTTING STRUCTURE FOR EARTH BORING DRILL BITS

BACKGROUND OF THE INVENTION

1. Field of the Invention

The invention relates to drill bits used for boring or penetrating the earth. In particular, the invention is a new fixed cutter drill bit with cutting elements arranged in a manner to actively cut the gauge portions of a borehole in the earth to facilitate directional drilling.

2. Description of the Related Art

Until relatively recently, a primary design goal for the designers of both fixed and rolling cutter earth boring drill bits was to design bits which would drill straight holes through the earth in spite of the tendency of the bit to follow along the dips and strikes of bedded rock formations in the earth. A great body of design knowledge accumulated over the years has taught these bit designers how to adjust the bit design parameters to accomplish straight hole drilling.

However, a division occurred early on in the body of straight hole drilling knowledge between fixed cutter drill bits and rolling cutter drill bits. Even though the broad concepts to accomplish straight hole drilling are common to both bit types, the specific bit design parameters are drastically different. Excellent discussions of straight hole and directional drilling for rolling cutter drill bits may be found in U.S. Pat. Nos. 5,372,210 and 4,231,438 both herein incorporated by reference for all they disclose.

By contrast, fixed cutter drill bit designs often provide quite different features than rolling cutter drill bits for straight hole drilling. For instance, rather than providing a relatively sharp corner to the gauge as described in the above rolling cutter bit Patents, fixed cutter drill bits tend to provide a long gauge section with a rounded transition to promote straight hole drilling.

Very recently, however, interest has been focused on making drill bits easy to steer while drilling the earth, a method known as directional drilling. In directional drilling, it is still necessary to make bits that do not wander from the desired path along the dips and strikes in the formation. However, the bits have the added constraint that they must be easy to steer, and predictably hold along a horizontal trajectory while drilling.

There are two common ways to steer a drill bit. The first and more common method may be called "pointing the bit". This conventional approach to drilling a directional well uses a downhole motor that uses fluid flow to produce downhole rotation, independent of string rotation, and an angled bend for orientation of the tool face. This is usually accomplished by providing a bent section between the drill bit and a downhole motor such that the axis of the bit is not co-linear with the rest of the bottom hole assembly. To steer, the drill string and bottom hole assembly is rotated until the bit is pointed in the desired direction. The drill string is then prevented from rotation, while the downhole motor is activated to rotate the bit. This part of the "pointing the bit" method is known as the sliding mode because only the bit is rotating. The remainder of the drill string is caused to slide through the hole without rotation while the bit is drilling. In this mode, the bit will drill ahead, constantly building up the angle of the hole in the desired direction.

With the motor in sliding mode (drill string is stationary), torque and drag is generated by the bit which result in toolface fluctuations and reduced directional control. Transfer of weight to the bit can be irregular which will produce varying torque due to changes in the depth of cut, resulting in a reduced penetration rate. The lack of toolface control can result in severe doglegs and high tortuosity of the well. This may cause problems later on when it comes to casing the borehole, and during well completion. As directional complexity and length of horizontal sections increase, these problems become more significant.

In order to control how quickly the angle builds, the motor is periodically stopped and the entire assembly is rotated. A drill bit operated in this mode is forced by the bent sub to rotate in an orbiting motion and the bit tends to drill a hole larger than gauge diameter. Rotating in this manner also puts extreme loads on the gauge cutting elements of the bit, leading to premature wear.

Although this method of steering a bit has been extensively used, there are many problems. With conventional steerable assemblies using mud motors, directional changes are performed with the drill stationary and with a bend in the motor positioned to attain required tool face orientation. Upon drilling, the bit generates a reactive torque that proceeds to wind the string up. If the resultant reactive torque from the bit proves to be greater than the torque capability of the motor, the motor will stall. If this occurs, the assembly must be picked up off bottom and tool face orientation must be re-established. Torque fluctuation while sliding will also create changes in the orientation of the toolface and make steering difficult.

This problem has been addressed in the past by using rolling cutter drill bits or PDC fixed cutter bit designs with high backrake angles i.e. less aggressive bits. The compensation for increased tool face control is a loss in achievable penetration rates.

A newer approach which solves many of these limitations is a method known as "push the bit". In this method, a rotary steerable tool is able to make changes in inclination and azimuth with continuous rotation of the drill string. This leads to a cleaner, smoother hole,. and less drag, which is beneficial for drilling extended reach wells. A smoother transfer of weight to the bit will lead to increased penetration rates.

A tool commercially available for the "push the bit" method typically consists of two main elements. The first element is a unit that contains mechanical components that can apply a lateral directional force ('side force') against the well bore. This is intended to push the bit in the opposite direction to the steering force imposed and can be used to make three-dimensional adjustments. The second element is a control unit housing the control electronics and sensors and may also contain measuring while drilling (MWD) and/or logging while drilling (LWD) sensors. This control unit is independent of external rotational speed. Programming and monitoring of the tool can be made at surface via the use of mud pulses. This communication with the tool can be made while continually drilling. One particular rotary steerable tool of this type is known as a side force rotary steerable (SFRS) tool and is described in U.S. Pat. Nos. 5.265,682; 5,553,679; 5,582,259; 5,603,385; 5,685,379; 5,706,905; 5,778,992; 5,803,185 all herein incorporated by reference for all they disclose.

Several functional qualities are required in a fixed cutter drill bit to properly operate with a SFRS tool.

A SFRS tool is commonly used in high inclination and horizontal wells and thus the drill bit should be of short length and possess the ability to move laterally. This allows the bit to make accurate and immediate responses to the directional changes initiated by the tool, resulting in improved dogleg potential.

The bit design should not induce significant vibration downhole, which could cause premature failure to the bit or tool. In general, high levels of lateral vibration (bit whirl) will lead to damage and eventual fatigue failure of the weakest part of the drill string. In the case of a SFRS system, damage can occur to the mechanical units that are used to actuate the directional moves. The sensitive electronic components in the control unit are also vulnerable to severe bit whirl.

Torsional vibration (stick-slip) is a major cause of bit and drill string failures. The use of a SFRS system, when compared to a conventional steerable motor is more likely to witness incidents of stick-slip due to the generally lower rotational speeds and the stiffness of the assembly. It has been observed that instances of stick-slip seem to correspond to changes in the strength of the rock being drilled.

From past experience, particularly in North Sea applications, the bit will be expected to drill through interbedded formations where hard stringers will be encountered. This type of formation is known to be the cause of cutter failure in PDC type fixed cutter drill bits, and is suspected to be the cause of torsional vibrations.

In the past, it had been assumed that increasing the anisotropic index of a bit was the primary requirement for fulfilling the above requirements for a fixed cutter drill bit to properly operate with a SFRS tool. The anisotropic index of a bit is defined as the ratio of axial drilling force to lateral drilling force to achieve a given penetration rate. A more detailed description of the anisotropic index may be found in a paper by Clegg, J. M., entitled "An analysis of the Field Performance of Antiwhirl PDC Bits" Society of Petroleum Engineers paper SPE 23868, presented at the 1992 IADC/SPE Drilling Conference, New Orleans, 18–20 February., 1992. The anisotropic index is also described in U.S. Pat. Nos. 5,456,141 and 5,608,162 both herein incorporated by reference for all they disclose.

Heretofore it was believed that the increase in the anisotropic index caused by modifying the bit profile was all that was necessary for use with the SFRS tool. The relative advantages in steerability induced by the changing the profile of a bit may be compared by calculating the anisotropic index for each design. This figure can then be used to determine the amount of force required to push the bit at a specific build rate. By comparison of the required steering forces of varying cutter profiles, bit designs may be ranked by their sensitivity to lateral. deviation. It has been found, however that maximizing the anisotropic index of a bit does not necessarily make it the best design for properly operating with a SFRS tool.

One type of conventional bit with a very high anisotropic index is known as a sidetrack bit. The common characteristics of sidetrack bits are their flat face profiles, very low gauge height to overall height ratios, and very 'sharp, aggressive gauge sections. Although these types of bits perform well for the specialized task of side tracking, they have proven to be too unstable for use with a SFRS tool. In fact these bits tend to have high, relatively unpredictable amounts of lateral vibrations, as well as experiencing severe stick-slip (torsional vibrations). When conventional approaches for mitigating these problems for PDC type bits, such as increasing the backrake of the cutters, are applied, the resulting anisotropic index also significantly drops.

Prior to the present invention, PDC type fixed cutter drill bits with a combination of high ratios of axial drilling force to lateral drilling force (high anisotropic indices) and low levels of both lateral and torsional vibrations, that are desirable for use with a SFRS tool were not available.

BRIEF SUMMARY OF THE INVENTION

The present invention is a drag-type drill bit for use with a side force rotary steerable (SFRS) tool that provides a combination of a relative high ratio of axial drilling force to lateral drilling force while providing relatively low levels of both lateral and torsional vibrations.

This is accomplished by providing a new drag-type drill bit for drilling a borehole in the earth. The bit is designed to rotate about a central axis of rotation and has a bit body having a leading face, an end face, a gauge region, and a shank for connection to a drill string, a plurality of nozzles in the bit body for delivering drilling fluid to the end face, a plurality of blades upstanding from the leading face of the bit body and extending outwardly away from the central axis of rotation of the bit. Each blade terminates in a gauge pad which has a surface which faces a wall of the borehole. A first plurality of cutters are mounted on the blades at the end face of the bit body and a second plurality of cutters are mounted the gauge pads and arranged such that in operation, they cut the wall of the borehole. Each one of the second plurality of cutters has a backrake less than or equal to about 20 degrees. A plurality of non-cutting bearing element are mounted on the gauge pads in a trailing relationship relative to the rotation of the bit behind at least some of the second plurality of cutters. The surface of the gauge pad is relieved from the borehole by at least 3 mm.

It has been found that it is important to maintain the at least 3 mm of relief between the gauge pads and the borehole in order to provide space for drilling fluid to flow about the cutters provided thereon. The beneficial effect of the relief is reduced, however, when a relief greater than 7 mm is provided, due to fluid erosion. Therefore the optimal relief between the gauge pad and the borehole is between about 3 mm and about 7 mm.

It has also been found advantageous that each one of the first plurality of cutters have a backrake of between about 15 degrees and about 20 degrees.

It has also been found advantageous for drill bits made in accordance with the present invention that the portion of the first plurality of cutters located in the cone region of the bit preferably to have a backrake of about 15 degrees. In addition, it has been found advantageous that the portion of the first plurality of cutters located in the shoulder region of the bit preferably have backrakes of about 20 degrees.

The second plurality of cutters may be PDC type cutters having curvilinear cutting faces, preferably circular cutting faces.

It is also advantageous to provide a bottom hole assembly which includes a side force rotary steerable system (SFRS) along with the aforementioned drill bit.

BRIEF DESCRIPTION OF THE DRAWINGS

FIG. 3 is a bottom view of the drill bit of FIG. 1.

FIG. 4 illustrates the drill bit of FIG. 2 drilling in a borehole.

DETAILED DESCRIPTION OF THE INVENTION AND THE PREFERRED EMBODIMENT

Figure 1:
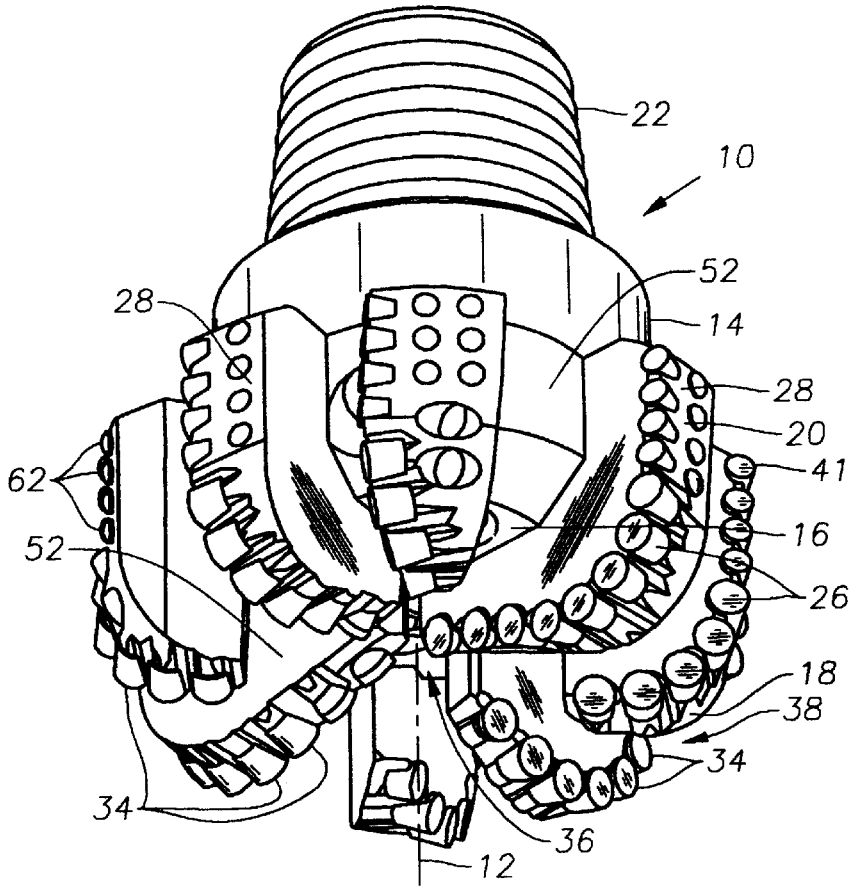
FIG. 1 is a perspective view of a drag-type earth boring bit of the present invention.
Figure 2:
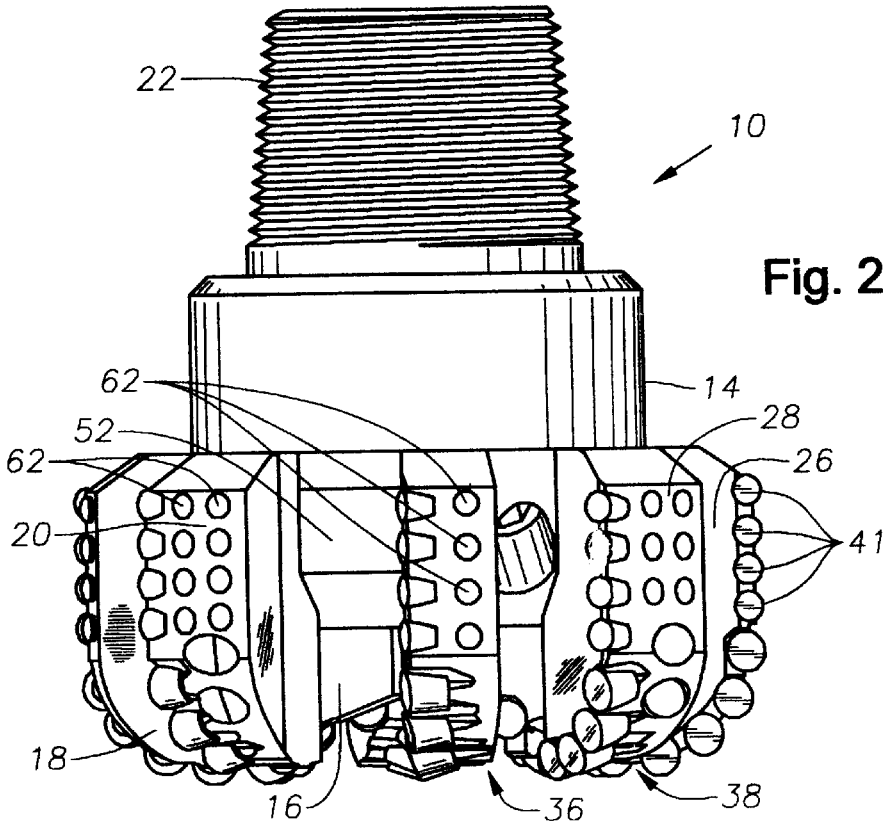
FIG. 2 is a side view of the drill bit of FIG. 1.

Turning now to the drawing FIGS. 1 through 4, a fixed cutter drill bit of the present invention is illustrated and generally designated by the reference numeral 10. The drill bit 10 has a central axis of rotation 12 and a bit body 14 having a leading face 16, an end face 18, a gauge region 20, and a shank 22 for connection to a drill string 24. A plurality of blades 26 are upstanding from the leading face 16 of the bit body and extend outwardly away from the central axis of rotation 12 of the bit 10. Each blade 26 terminates in a gauge pad 28 which faces a wall 30 of the borehole 32.

A number of cutters 34 are mounted on the blades 26 at the end face 18 of the bit 10 in both the cone region 36 and the shoulder region 38 of the end face 18. Another group of cutters 34 are mounted on the gauge pads 28.

Figure 6:
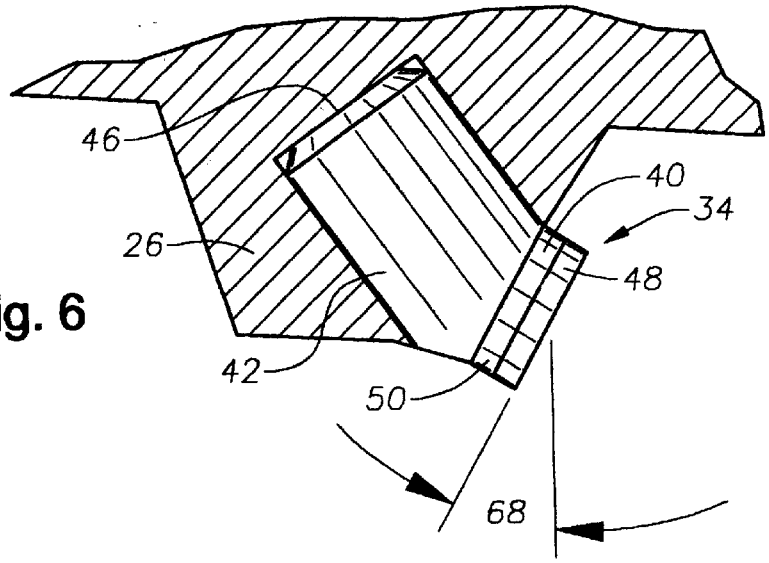
FIG. 6 is a partial section of the body of the drill bit in FIG. 1 illustrating the arrangement of a cutter in the body of the bit.

As shown in FIG. 6, each of the cutters 34 partially protrude from their respective blade 26 and are spaced apart along the blade 26, typically in a given manner to produce a particular type of cutting pattern.

Many such patterns exist which may be suitable for use on the drill bit 10 fabricated in accordance with the teachings provided herein, a cutter 34 typically includes a preform cutting element 40 that is mounted on a carrier 42 in the form of a stud which is secured within a socket 46 in the blade 26. Typically, each preform cutting element 40 is a curvilinear shaped 41, preferably circular tablet of polycrystalline diamond compact (PDC) 48 or other suitable superhard material bonded to a substrate 50 of a tungsten carbide, so that the rear surface of the tungsten carbide substrate may be brazed into a suitably oriented surface on the stud which may also be formed from tungsten carbide.

While the leading face 16 of the drill bit 10 is responsible for cutting the underground formation, the gauge region 20 is generally responsible for stabilizing the drill bit 10 within the borehole 32. The gauge region 20 typically includes extensions of the blades 26 which create channels 52 through which drilling fluid may flow upwardly within the borehole 32 to carry away the cuttings produced by the leading face 16. In operation, the cutters 34 on the gauge pads 28 cut the wall 30 of the borehole 32 to the gauge diameter of the bit 10.

In the prior art, the blade extensions are typically referred to as kickers because they engage the wall 30 of the borehole 32 to stabilize a bit. However, kickers differ from the gauge pads 28 of the present invention in that gauge pads 28 are relieved (as shown in numeral 56) from the wall 30 of the borehole 32. This is represented in FIG. 3 where the circle 58 inscribed about the bit 10 is representative of the wall 30 of the borehole 32 drilled by this bit 10. The relief 56 is shown between the circle 58 and the surface of the gauge pad 28.

Within the bit body 14 is passaging (not shown) which allows pressurized drilling fluid to be received from the drill string and communicate with one or more orifices 54 located on or adjacent to the leading face 16. These orifices 54 accelerate the drilling fluid in a predetermined direction. The surfaces of the bit body 14 are susceptible to erosive and abrasive wear during the drilling process. A high velocity drilling fluid cleans and cools the cutters 34 and flows along the channels 52, washing the earth cuttings away from the end face 18. The orifices 54 may be formed directly in the bit body 14, or may be incorporated into a replaceable nozzle.

Figure 5:
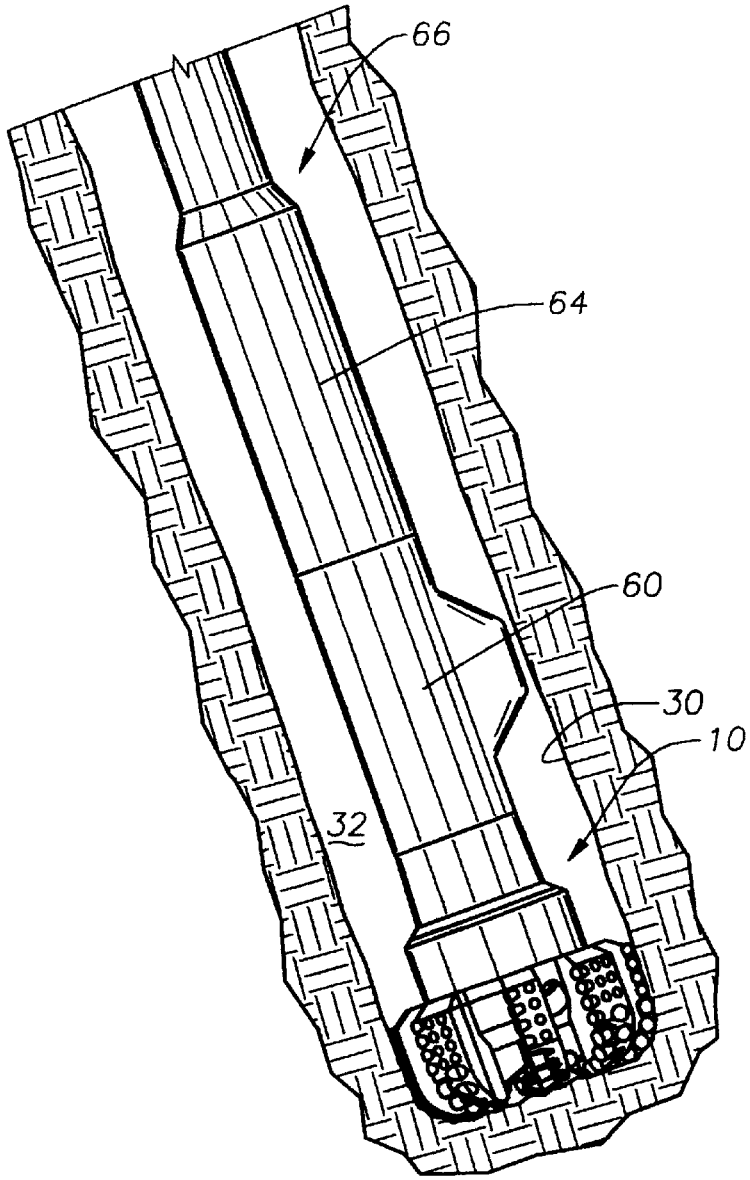
FIG. 5 illustrates the drill bit of FIG. 2 drilling in a borehole as part of a bottom hole assembly with a downhole motor and a side force rotary steerable (SFRS) tool.

The action of the drilling fluid is important in the present invention. It would be appreciated by those skilled in the art that amount of the relief 56 does not need to be more that a very small amount, say 1 mm, in order to make the bit 10 effective for use with a side force rotary steerable (SFRS) tool 60 shown in FIG. 5. This is because only a very small cut, less than 1 mm, in the wall 30 is all that is required during each revolution of the bit to provide effective steering. In the prior art, it has been found that cutters 34 on the gauge portion of bits often experience excessive wear. It has been =assumed that this wear was due mainly to the abrasive actions of the earth being drilled. As a result, cutters in the gauge area were usually made flush with the kickers, or had very little exposure. Furthermore, in order to provide stability of the bit for both torsional and lateral vibrations, the prior art strongly teaches that large portions of the gauge area of bits need to be flush with the wall of the borehole, as shown in numerous U.S. Patents, particularly U.S. Pat. Nos. 5,992,547; 5,967,246; 5,904,213; 5,819,860; 5,671,818; 5,651,421, all herein incorporated by reference for all they disclose.

However, a surprising result of the present invention is that increasing the relief 56 reduces the wear on the cutters 34 when the bit 10 is run. Tests have demonstrated that reliefs of greater than or equal to about 3 mm are effective for reducing the wear of the cutters 34 on the gauge pads 28 to very low values, near zero. It is believed that the wear reduction of the cutters 34 is due to the cooling action provided by the action of the drilling fluid. Reliefs 56 of less than 3 mm do not allow effective fluid flow about the cutters 34 on the gauge pads 28. Therefore, the minimum effective relief 56 is about 3 mm.

The beneficial effect of the relief 56 is reduced, however, when a relief 56 greater than 7 mm is provided, due to fluid erosion on the gauge pad 28. Therefore the optimal range of relief 56 is between about 3 mm and about 7 mm.

It is also believed that the curvilinear shape 41 of the cutters 34 on the gauge pads 28 also surprisingly helps reduce the wear rate. Conventional logic would argue that the increased contact area against the wall 30 of the borehole 32 provided by the typical prior art flat-edged gauge cutter would reduce unit loading during operation, and subsequently reduce the wear. However, just the opposite has proven true.

A curvilinear shape 41 to the cutters 34 allows only a small area of the cutter 34 to engage the wall 30 compared to the flattened cutters known in the prior art. This small area of engagement reduces side loading forces imposed on the cutters 34 from the wall 30 when the SFRS tool 60 is pushing the bit. The side loading forces are caused by the slight tilting of the gauge pads 28 as the SFRS tool 60 engages the wall 30 to push the bit. In effect, the push action causes a slight pinching action as cutters 34 in the gauge pads 28 on opposite sides of the bit engage. The curvilinear shape 41 to the cutters 34 allows the area of engagement of the cutters 34 in the gauge pads 28 to remain nearly constant in spite of this movement. By contrast, in the flatted gauge cutters of the prior art, the engaged area of the cutter tends to decrease from the pinching action, causing the unit loading on the cutter to dramatically increase, leading to physical and thermal degradation.

As stated earlier, any curvilinear shape 41 to the cutters 34 in the gauge pads 28 would be effective. However, a circular shape is preferred. Of course, it is not necessary to make all the cutters 34 in the gauge pads 28 have the same form of curvilinear shape 41. In fact, under some types of operating conditions, it may be advantageous to selectively place different curvilinear shapes 41 along the length of the gauge pads 28.

Also mounted on the gauge pads 28 are a plurality of non-cutting bearing elements 62. The non-cutting bearing elements 62 assure that proper bit stability is maintained when the bit 10 is used with the SFRS tool 60. The non-cutting bearing elements 62 are arranged such that they bear against the wall 30 of the borehole 32 during drilling and are generally aligned behind the cutters 34 in the gauge pads 28 relative to the rotation of the bit. In this manner the corresponding non-cutting bearing elements 62 trail the cutters 34 in the gauge pads 28 during drilling.

It is not necessary for each of the cutters 34 in the gauge pads 28 to have a corresponding non-cutting bearing element 62. Nor is it necessary for each non-cutting bearing element 62 to have a corresponding cutter 34 in a gauge pad 28. However, it has been found that in order to effectively perform with the SFRS tool 60, the bit 10 must have one or more corresponding non-cutting bearing elements 62 trailing at least a majority of the cutters 34 in the gauge pads 28. Preferably, a non-cutting bearing element 62 is mounted at a common height along the central axis 12 of the bit 10 as its corresponding cutter 34 in the gauge pad 28.

The exposed, curvilinear cutters 34 in the gauge pads 28 combined with the a non-cutting bearing elements 62 provide a bit with an actively cutting gauge section, that is also quite stable, with a minimum of lateral vibrations, (also known as bit whirl). In order to reduce the torsional (or stick-slip) vibrations another surprising feature is added to the cutters 34 in the gauge pads 28.

Normally, cutters 34 would have backrakes 68 (as shown in FIG. 6) of about 30 degrees. Backrake 68 is defined as the angle the face of a PDC 48 is swept back, relative to the rotation of the bit from the central axis of rotation 12 of the bit 10. Backrake 68 on cutters 34 is very well known in the art and does not require elaboration. However, it is well established that decreasing the backrake 68 makes a bit drill more aggressively. It is also very well know that in order to reduce the torsional (or stick-slip) vibrations, it is necessary to make the bit drill less aggressively, i.e. to increase the backrakes of the cutters.

In the present invention, the backrakes 68 of a plurality of the cutters 34 in the gauge pads 28 are set at about 20 degrees or less. Although those skilled in the art would have predicted that this large decrease in backrake 68 from the typical 30 degrees would cause severe stick-slip behavior in the bit, quite the opposite has been the case. It is believed that the unexpected reduction in stick-slip behavior from reducing the backrake 68 is due to the interaction of the cutters 34 in the gauge pads 28 with the non-cutting bearing element 62. It has been observed that instances of stick-slip seem to correspond to changes in the strength of the rock being drilled. In conventional bits, when a hard streak is encountered, the bit tends to 'dig in' due to the very quickly increasing reaction forces. In the present invention, however, the more aggressive backrake angle 68 setting of about 20 degrees or less combined with the limited penetration allowed by the non-cutting bearing elements 62 allow the bit 10 to cut without generating unusually high reaction forces. Although it is possible to have improved performance with only a few of the cutters 34 in the gauge pads 28 with backrakes 68 of about 20 degrees or less, it is preferred that at least a majority of these the cutters 34 in the gauge pads 28 have backrakes 68 of about 20 degrees or less. Additionally, it is preferable to maintain the backrake 68 the cutters 34 in the gauge pads 28 between about 15 degrees and about 20 degrees.

This same line of reasoning also supports the decrease in backrake 68 of the cutters 34 in the cone region 36 from the typical 25–30 degrees to a very aggressive 15–20 degrees, preferably about 15 degrees. Cutters 34 in the shoulder region 38 also have backrakes 68 of from about 15 degrees to about 20 degrees. However, the preferred backrake 68 of cutters 34 in the shoulder region 38 is about 20 degrees. It was found that by making backrake 68 of cutters 34 in these regions more aggressive, the cutters 34 tended to have less wear when drilling hard streaks, and were therefore less prone to experience rapidly increasing reaction forces. This reduction in backrake 68 of cutters 34 in the cone region 36 and in the shoulder region 38 also helps to increase the drilling rate of penetration of the bit 10.

In a manner similar to above, although it is possible to have improved performance with only a few of the cutters 34 in either the cone region 36 or the shoulder region 38 to have backrakes 68 of about 15 to about 20 degrees, it is preferred that at least a majority of these cutters have backrakes 68 of about 15 degrees to about 20 degrees.

The drill bit 10 of the present invention is intended to be combined in a bottom hole assembly (BHA) 66 with a drilling motor 64 and a side force rotary steerable (SFRS) tool 60. In this arrangement, the drill string would be considered to be the SFRS tool 60, the drilling motor 64 and all the other elements that connect the BHA 66 to the surface. When a drill bit 10 of the present invention having a combination of a high ratio of axial drilling force to lateral drilling force (high anisotropic index) and low levels of both lateral and torsional vibrations is combined with a drilling motor 64 and with a SFRS tool 60, efficiencies and accuracy's in rotary steerable drilling systems heretofore unattainable, are now possible.

Whereas the present invention has been described in particular relation to the drawings attached hereto, it should be understood that other and further modifications apart from those shown or suggested herein, may be made within the scope and spirit of the present invention.

What is claimed is:

1. A drag-type drill bit for drilling a borehole in the earth, the drill bit arranged for rotation about a central axis and comprising a bit body having a leading face, an end face, a gauge region, and a shank, a plurality of nozzles in the bit body for delivering a drilling fluid to the end face, a plurality of blades upstanding from the leading face of the bit body and extending outwardly away from the central axis of rotation of the bit, each blade terminating in a gauge pad having a surface which faces a wall of the borehole, a first plurality of cutters mounted on the blades at the end face of the bit body and a second plurality of cutters mounted on the gauge pads, the second plurality of cutters arranged such that, in operation, they cut the wall of the borehole, wherein each of the second plurality of cutters has a backrake less than or equal to about 20 degrees, a plurality of non-cutting bearing elements arranged to bear against the wall of the borehole are mounted on the gauge pads in the trailing relationship relative to the rotation of the bit behind at leas some of the second plurality of cutters, thereby limiting the cut of the second plurality of cutters into the wall of the borehole, and the surfaces of the gauge pads are relieved from the wall of the borehole by at least about 3 mm.

2. The drag-type drill bit of claim 1 wherein each of the first plurality of cutters has a backrake of between about 15 degrees and about 20 degrees, and the first plurality of cutters comprises a majority of all the cutters mounted on the blades at the end face of the bit body.

3. The drag-type drill bit of claim 2 wherein the end face of the bit body has a cone region, the first plurality of cutters in the cone region having a backrake of about 15 degrees.

4. The drag-type drill bit of claim 2 wherein the end face of the bit body has a shoulder region, the first plurality of cutters in the shoulder region having a backrake of about 20 degrees.

5. The drag-type drill bit of claim 1 wherein the second plurality of cutters comprises a majority of all the cutters mounted on the gauge pads.

6. The drag-type drill bit of claim 5 wherein the end face of the bit body has a cone region, a majority of the cutters in the cone region having a backrake of about 15 degrees, and the end face of the bit body has a shoulder region, a majority of the cutters in the shoulder region having a backrake of about 20 degrees and the plurality of non-cutting bearing elements are mounted on the gauge pad behind a majority of the second plurality of cutters.

7. The drag-type drill bit of claim 1 wherein each of the second plurality of cutters has a front face with a curvilinear shape.

8. The drag-type drill bit of claim 1 wherein the surfaces of the gauge pads are relieved from the wall of the borehole by between about 3 mm and about 7 mm.

9. The drag-type drill bit of claim 1 wherein the plurality of non-cutting bearing elements are mounted on the gauge pad behind a majority of the second plurality of cutters.

10. The drag-type drill bit of claim 1 wherein the end face of the bit body has a cone region, a plurality of cutters in the cone region having a backrake of about 15 degrees, and the end face of the bit body has a shoulder region, a plurality of cutters in the shoulder region having a backrake of about 20 degrees and the plurality of non-cutting bearing elements are mounted on the gauge pad behind a majority of the second plurality of cutters.

11. The drag-type drill bit of claim 10 wherein the surfaces of the gauge pads are relieved from the wall of the borehole by between about 3 mm and about 7 mm.

12. A bottom hole assembly comprising a side force rotary steerable tool and a drag-type drill bit for drilling a borehole in the earth, the drill bit arranged for rotation about a central axis and comprising a bit body having a leading face, and end face, a gauge region, and a shank, a plurality of nozzles in the bit body for delivering drilling fluid to the end face, a plurality of blades upstanding from the leading face of the bit body and extending outwardly away from the central axis of rotation of the bit, each blade terminating in a gauge pad having a surface which faces a wall of the borehole, a first plurality of cutters mounted on the blades at the end face of the bit body and a second plurality of cutters mounted on the gauge pads, the second plurality of cutters arranged such that, in operation, they cut the wall of the borehole, wherein each of the second plurality of cutters has a backrake less than or equal to about 20 degrees, a plurality of non-cutting bearing elements arranged to bear against the wall of the borehole are mounted on the gauge pads in a trailing relationship relative to the rotation of the bit behind at least some of the second plurality of cutters, thereby limiting the cut of the second plurality of cutters into the wall of the borehole, and the surface of the gauge pads are relieved from the wall of the borehole by at least about 3 mm.

13. The bottom hole assembly of claim 12 wherein each of the first plurality of cutters has a backrake of between about 15 degrees and about 20 degrees, and the first plurality of cutters comprise a majority of all the cutters mounted on the blades at the end face of the bit body.

14. The bottom hole assembly of claim 13 wherein the end face of the bit body has a cone region, the first plurality of cutters in the cone region having a backrake of about 15 degrees.

15. The bottom hole assembly of claim 13 wherein the end face of the bit body has a shoulder region, the first plurality of cutters in the shoulder region having a backrake of about 20 degrees.

16. The bottom hole assembly of claim 12 wherein the second plurality of cutters comprises a majority of all the cutters mounted on the gauge pads.

17. The bottom hole assembly of claim 16 wherein the end face of the bit body has a cone region, a majority of the cutters in the cone region having a backrake of about 15 degrees, and the end face of the bit body has a shoulder region, a majority of the cutters in the shoulder region having a backrake of about 20 degrees and the plurality of non-cutting bearing elements are mounted on the gauge pad behind a majority of the second plurality of cutters.

18. The bottom hole assembly of claim 12 wherein each of the second plurality of cutters has a front face with a curvilinear shape.

19. The bottom hole assembly of claim 12 wherein the surfaces of the gauge pads are relieved from the wall of the borehole by between about 3 mm and about 7 mm.

20. The bottom hole assembly of claim 12 wherein the plurality of non-cutting bearing elements are mounted on the gauge pad behind a majority of the second plurality of cutters.

21. The bottom hole assembly of claim 12 wherein the end face of the bit body has a cone region, a plurality of cutters in the cone region having a backrake of about 15 degrees, and the end face of the bit body has a shoulder region, a plurality of cutters in the shoulder region having a backrake of about 20 degrees and the plurality of non-cutting bearing elements are mounted on the gauge pad behind a majority of the second plurality of cutters.

22. The bottom hole assembly of claim 21 wherein the surfaces of the gauge pads are relieved from the wall of the borehole by between about 3 mm and about 7 mm.

* * * * *